US010136748B1

(12) United States Patent
Blunt

(10) Patent No.: US 10,136,748 B1
(45) Date of Patent: Nov. 27, 2018

(54) HOLIDAY TREE WITH CENTRAL SUPPORT, ROPE LIGHT AND STAND

(71) Applicant: Alice Blunt, Clearwater, FL (US)

(72) Inventor: Alice Blunt, Clearwater, FL (US)

( * ) Notice: Subject to any disclaimer, the term of this patent is extended or adjusted under 35 U.S.C. 154(b) by 0 days.

(21) Appl. No.: 15/614,820

(22) Filed: Jun. 6, 2017

(51) Int. Cl.
*A47G 33/06* (2006.01)
*F21S 4/26* (2016.01)
*F21W 121/04* (2006.01)

(52) U.S. Cl.
CPC ..... *A47G 33/06* (2013.01); *F21S 4/26* (2016.01); *F21W 2121/04* (2013.01)

(58) Field of Classification Search
CPC ..... A47G 33/08; A47G 2033/0827; A47G 33/06; F21S 4/26
See application file for complete search history.

(56) References Cited

U.S. PATENT DOCUMENTS 3,677,867 A 7/1972 Westlund
3,679,528 A * 7/1972 Spiegel ..... A47G 33/06 248/156
4,620,270 A * 10/1986 Laakso ..... A47G 33/06 362/123
5,336,536 A * 8/1994 Oberzan ..... A47G 33/06 211/196
6,048,590 A 4/2000 Phillips
6,132,063 A * 10/2000 Byers ..... A47G 33/06 362/238
6,379,021 B1 * 4/2002 Shieh ..... A47G 33/06 362/123
6,652,927 B1 11/2003 Chen
7,490,950 B1 2/2009 Meyers
8,272,754 B2 9/2012 Guinness
D668,174 S 10/2012 Bliss
9,671,074 B2 * 6/2017 Chen ..... A47G 33/06
2007/0177395 A1 * 8/2007 Bryant ..... A47G 33/06 362/431
2008/0283717 A1 11/2008 Kim

* cited by examiner

*Primary Examiner* — Robert J May
(74) *Attorney, Agent, or Firm* — Kyle A. Fletcher, Esq.

(57) ABSTRACT

The holiday tree kit is a decorative element suggestive of an illuminated tree which is suitable for use during holidays and special events. The holiday tree kit comprises a rope light that spirals down from the top of a support armature and widens as it descends. The holiday tree kit includes an illuminated tree top ornament that supports the rope light. The holiday tree kit provides stands that are suitable for indoor or outdoor use.

10 Claims, 4 Drawing Sheets

HOLIDAY TREE WITH CENTRAL SUPPORT, ROPE LIGHT AND STAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of holiday decorations, more specifically, a holiday tree kit.

SUMMARY OF INVENTION

The holiday tree kit is a decorative element suggestive of an illuminated tree which is suitable for use during holidays and special events. The holiday tree kit comprises a rope light that spirals down from the top of a support armature and widens as it descends. The holiday tree kit includes an illuminated tree top ornament that supports the rope light. The holiday tree kit provides stands that are suitable for indoor or outdoor use.

An object of the invention is to provide a decoration suggestive of an illuminated tree.

Another object of the invention is to provide a decoration that is appropriate for use during holidays and for special occasions such as weddings.

A further object of the invention is to provide the decoration in various sizes and stand options suitable for indoor and outdoor use.

These together with additional objects, features and advantages of the holiday tree kit will be readily apparent to those of ordinary skill in the art upon reading the following detailed description of the presently preferred, but nonetheless illustrative, embodiments when taken in conjunction with the accompanying drawings.

In this respect, before explaining the current embodiments of the holiday tree kit in detail, it is to be understood that the holiday tree kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the holiday tree kit.

It is therefore important that the claims be regarded as including such equivalent construction insofar as they do not depart from the spirit and scope of the holiday tree kit. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
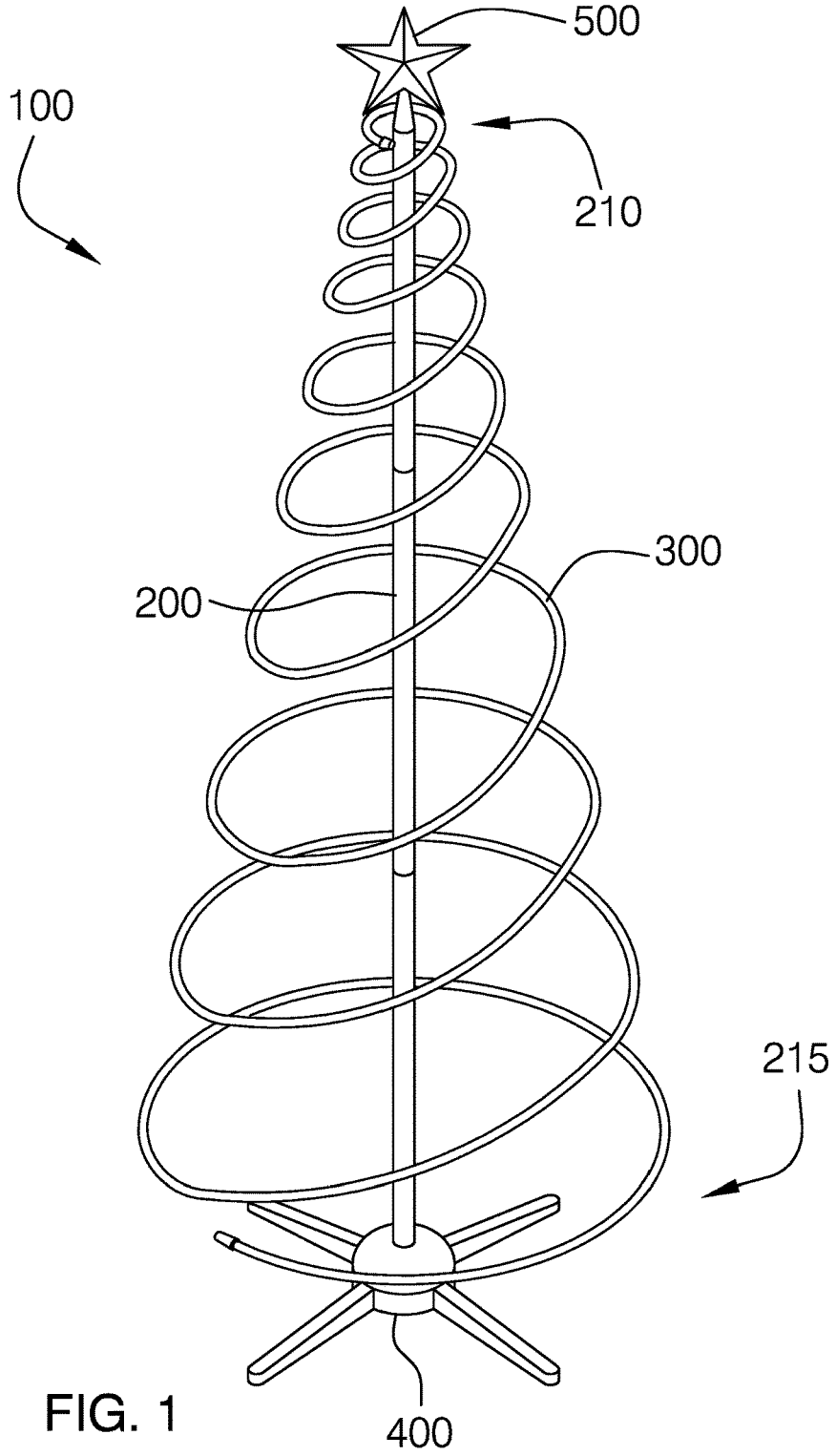
FIG. 1 is a perspective view of an embodiment of the disclosure.
Figure 2:
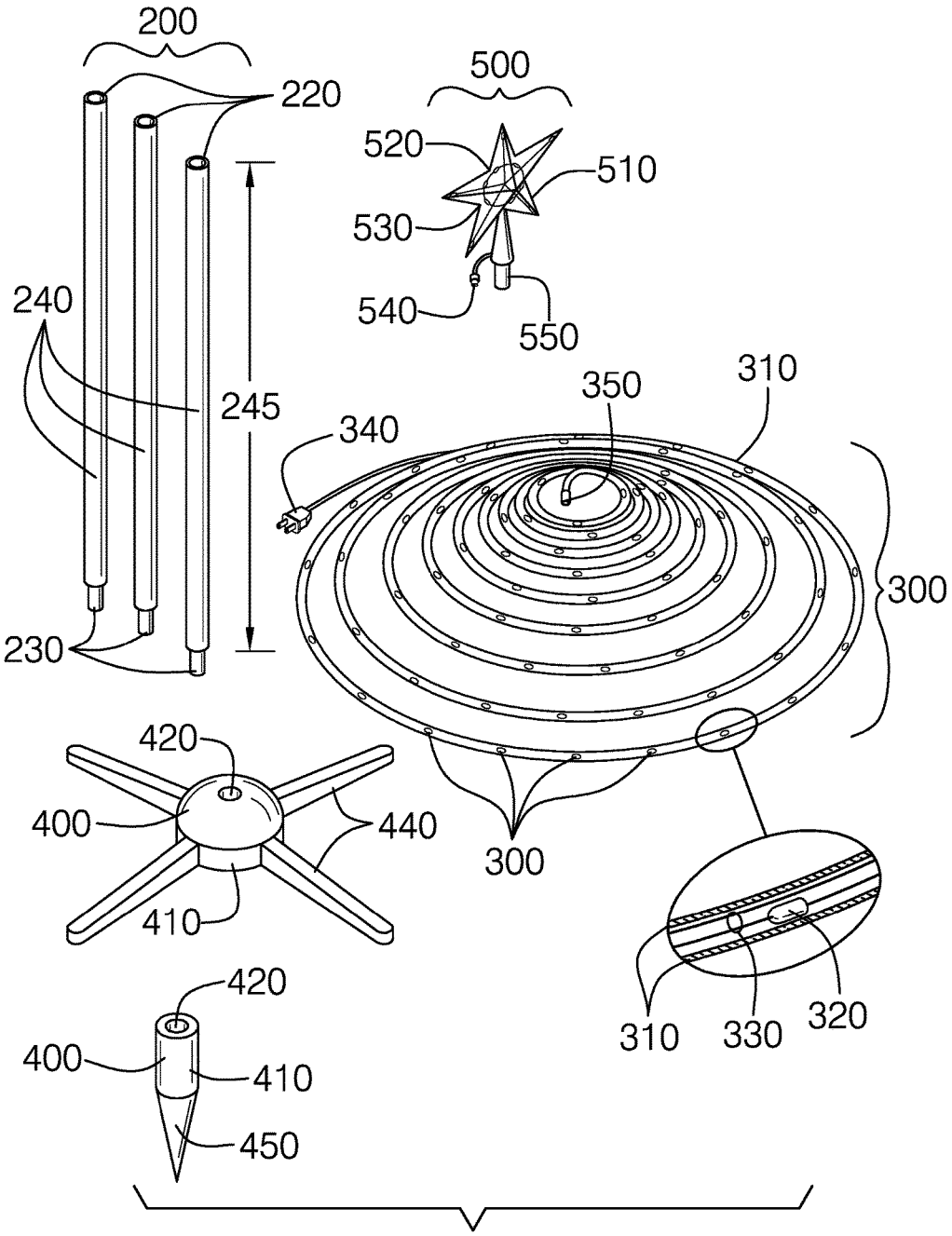
FIG. 2 is an exploded view of an embodiment of the disclosure.
Figure 3:
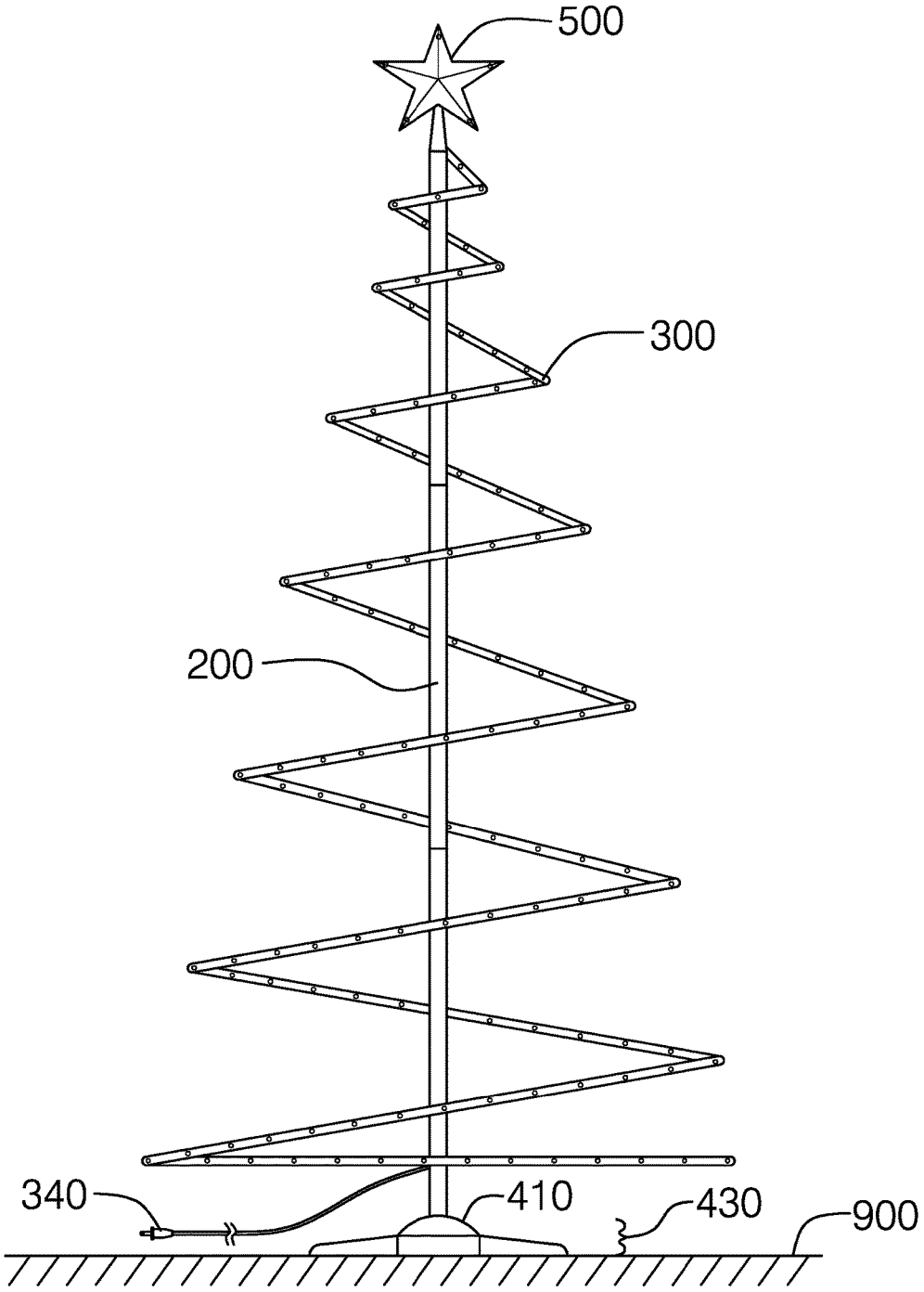
FIG. 3 is a side view of an embodiment of the disclosure.
Figure 4:
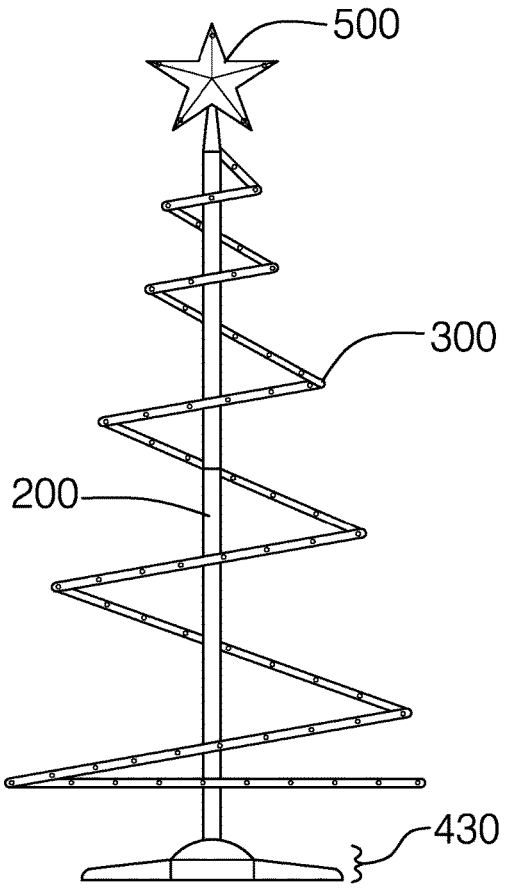
FIG. 4 is a side view of an embodiment of the disclosure where the overall height of the tree is reduced to approximately 4 ft.
Figure 5:
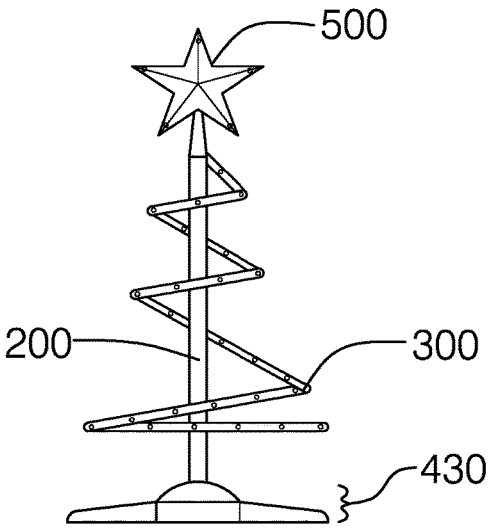
FIG. 5 is a side view of an embodiment of the disclosure where the overall height of the tree is reduced to approximately 2 ft.

Detailed reference will now be made to a first potential embodiment of the disclosure, which is illustrated in FIGS. 1 through 5.

The holiday tree kit 100 (hereinafter invention) comprises a central support armature 200, a rope light 300, a stand 400 and a top ornament 500. The invention 100 is a decorative item suggestive of a tree shape. The rope light 300 spirals down from a top 210 of the central support armature 200 and the spiral widens as it progresses downward. The stand 400 holds the invention 100 upright. The colors of the rope light 300 are chosen to be suggestive of the occasion for which the invention 100 is being displayed.

The central support armature 200 provides the main vertical support for the invention 100. The central support armature 200 may comprise one or more armature tubes 240. Each of the one or more armature tubes 240 comprise a top opening 220 and a bottom sleeve 230. The one or more armature tubes 240 interconnect by sliding the bottom sleeve 230 of one of the one or more armature tubes 240 into the top opening 220 of the one or more armature tube 240 below it. The central support armature 200 is then oriented vertically and a bottom 215 is placed into the stand 400. A length 245 of the one or more armature tube 240 in conjunction with a count of the number of the central support armature 200 determine the overall height of the invention 100.

As a non-limiting example, if three of the one or more armature tubes 240 are provided and each of the one or more armature tubes 240 is 2 feet long, then the overall height of the invention 100 will be approximately 6 ft. (See FIG. 3.) As a non-limiting example, if two of the one or more armature tubes 240 are provided and each of the one or more armature tubes 240 is 2 feet long, then the overall height of the invention 100 will be approximately 4 ft. (See FIG. 4) As a non-limiting example, if one of the one or more armature tubes 240 are provided and each of the one or more armature tubes 240 is 2 feet long, then the overall height of the invention 100 will be approximately 2 ft. (See FIG. 5.)

The rope light 300 comprises a hollow flexible tubing 310, LEDs 320, wiring 330, an AC plug 340 and a first lighting connector 350. The hollow flexible tubing 310 is transparent or translucent tubing that encloses the wiring 330 and the LEDs 320. The LEDs 320 are distributed throughout the length of the hollow flexible tubing 310. The wiring is electrically connected to the AC plug 340 on one end of the rope light 300, to the LEDs 320, and to the first lighting connector 350 on the other end of the rope light 300. When electricity is applied to the AC plug 340, the LEDs 320 illuminate the rope light 300. The first lighting connector 350 allows the top ornament 500 to be connected to the rope light 300. The LEDs 320 in the rope light 300 may be one or more colors. The colors of the LEDs 320 may be selected to be suggestive of the occasion for which the invention 100 is being displayed. As non-limiting examples, the invention 100 intended for use at Christmas may provide the LEDs 320 that are red and green, the invention 100 intended for use at a wedding may provide the LEDs 320 that are white, and the invention 100 intended for use around Independence Day may provide the LEDs 320 that are red, white, and blue.

The stiffness of the hollow flexible tubing 310 is selected to provide a gradual drop of the rope light 300 as it spirals down from the top 210 of the central support armature 200. If it is desired that the rope light 300 complete N revolutions around the central support armature 200 as it spirals down, then the stiffness of the hollow flexible tubing 310 is selected such that the rope light 300 drops approximately 1/Nth of the distance from the top 210 of the central support armature 200 to the bottom 215 of the central support armature 200 on each revolution. As a non-limiting example, if it is desired that the invention 100 be 6 ft tall and that the rope light 300 spirals around the invention 100 10 times, then 1/10th of 6 ft is 0.6 ft (or a little over 7 inches) and the stiffness of the rope light 300 would be selected so that the rope light 300 drops approximately 7 inches during one complete revolution.

The stand 400 comprises a stand body 410, an armature receptacle 420 and a ground interface 430. The stand 400 holds the central support armature 200 in a vertical orientation so that the invention 100 appears to stand upright. The stand body 410 is oriented vertically by the ground interface 430. The armature receptacle 420 at the top of the stand body 410 accepts the bottom sleeve 230 of the central support armature 200.

In some embodiments, the ground interface 430 may be a spike 450 protruding from the bottom of the stand body 410 of the stand 400. The spike 450 may be pushed into ground 900 when the invention 100 is displayed outdoors. In some embodiments, the ground interface 430 may comprise three or more legs 440 that are appropriate for use indoors. In some embodiment, the three or more legs 440 may be detachable from the stand body 410. (FIG. 2 includes a view of both embodiments of the stand 400—one spiked stand and one stand with legs).

The top ornament 500 comprises an ornamental shape 510, top lighting 520, top wiring 530, a second lighting connector 540 and an ornament sleeve 550. The top lighting 520 may reside on the outside surface of the top ornament 500, may be mounted within the top ornament 500, or a combination thereof. The top lighting 520 is electrically interconnected via the top wiring 530 and the top wiring 530 also connects the top lighting 520 to the second lighting connector 540. Power may be applied to the top lighting 520 via the second lighting connector 540 and the top wiring 530 by connecting the second lighting connector 540 to the first lighting connector 350 when the rope light 300 is powered.

The top ornament 500 serves as both a support element and a decorative element. The top ornament 500 is itself supported at the top 210 of the central support armature 200 by sliding the ornament sleeve 550 into the top opening 220 of the central support armature 200. In turn, the top ornament 500 supports the top 210 end of the rope light 300. The second lighting connector 540 of the top ornament 500 connects to the first lighting connector 350 of the rope light 300 and this connection is both an electrical connection to power the top lighting 520 and a mechanical connection to support the top 210 end of the rope light 300. As a non-limiting example, the first lighting connector 350 and the second lighting connector 540 may be matching twist-lock connections that will not separate if pulled away from each other.

As a decorative element, the ornamental shape 510 and color of the top lighting 520 may be selected to be suggestive of the occasion for which the invention 100 is being displayed. As non-limiting examples, the invention 100 intended for use at Christmas may provide the ornamental shape 510 which is a red and green star, the invention 100 intended for use at a wedding may provide the ornamental shape 510 which is a red heart, and the invention 100 intended for use around Independence Day may provide the ornamental shape 510 which is a red, white, and blue U. S. flag.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A holiday tree kit comprising:

a central support armature, a rope light, a stand and a top ornament;

wherein the holiday tree kit is a decorative item suggestive of a tree shape;

wherein the rope light spirals down from a top of the central support armature;

where the rope light spiral widens as it progresses downward;

wherein the stand holds the holiday tree kit upright;

wherein the colors of the rope light are chosen to be suggestive of the occasion for which the holiday tree kit is displayed;

wherein the central support armature provides the main vertical support for the holiday tree kit;

wherein the central support armature comprises one or more armature tubes;

wherein each of the one or more armature tubes comprise a top opening and a bottom sleeve;

wherein the one or more armature tubes interconnect by sliding the bottom sleeve of one of the one or more armature tubes into the top opening of the one or more armature tube below it;

wherein the central support armature is oriented vertically;

wherein a bottom of the central support armature is placed into the stand;

wherein a length of the one or more armature tube in conjunction with a count of the number of the central support armature determine the overall height of the holiday tree kit;

wherein the rope light comprises a hollow flexible tubing, LEDs, wiring, an AC plug and a first lighting connector;

wherein the hollow flexible tubing is transparent or translucent tubing;

wherein the hollow flexible tubing encloses the wiring and the LEDs;

wherein the LEDs are distributed throughout the length of the hollow flexible tubing;

wherein the wiring is electrically connected to the AC plug on one end of the rope light, to the LEDs, and to the first lighting connector on the other end of the rope light;

wherein when electricity is applied to the AC plug, the LEDs illuminate the rope light;

wherein the first lighting connector allows the top ornament to be connected to the rope light;

wherein the LEDs in the rope light are one or more colors which are selected to be suggestive of the occasion for which the holiday tree kit is displayed;

wherein the stiffness of the hollow flexible tubing is selected to provide a gradual drop of the rope light as it spirals down from the top of the central support armature;

where for the rope light that completes N revolutions around the central support armature as it spirals down, the stiffness of the hollow flexible tubing is selected such that the rope light drops approximately 1/Nth of the distance from the top of the central support armature to the bottom of the central support armature on each revolution.

2. The holiday tree kit according to claim 1 wherein the stand comprises a stand body, an armature receptacle and a ground interface;

wherein the stand holds the central support armature in a vertical orientation so that the holiday tree kit appears to stand upright;

wherein the stand body is oriented vertically by the ground interface;

wherein the armature receptacle at the top of the stand body accepts the bottom sleeve of the central support armature.

3. The holiday tree kit according to claim 2 wherein the ground interface is a spike protruding from the bottom of the stand body of the stand;

wherein the spike is pushed into the ground when the holiday tree kit is displayed outdoors.

4. The holiday tree kit according to claim 2 wherein the ground interface comprises three or more legs that are for use indoors.

5. The holiday tree kit according to claim 4 wherein the three or more legs are detachable from the stand body.

6. The holiday tree kit according to claim 2 wherein the top ornament comprises an ornamental shape, top lighting, top wiring, a second lighting connector and an ornament sleeve;

wherein the top lighting is electrically interconnected by the top wiring;

wherein the top wiring connects the top lighting to the second lighting connector.

7. The holiday tree kit according to claim 6 wherein power is applied to the top lighting via the second lighting connector and the top wiring by connecting the second lighting connector to the first lighting connector when the rope light is powered.

8. The holiday tree kit according to claim 7 wherein the top ornament serves as both a support element and a decorative element;

wherein the top ornament is supported at the top of the central support armature by sliding the ornament sleeve into the top opening of the central support armature;

wherein the top ornament supports the top end of the rope light.

9. The holiday tree kit according to claim 8 wherein the second lighting connector of the top ornament connects to the first lighting connector of the rope light and this connection is both an electrical connection to power the top lighting and a mechanical connection to support the top end of the rope light.

10. The holiday tree kit according to claim 9 wherein the ornamental shape and color of the top lighting is selected to be suggestive of the occasion for which the holiday tree kit is displayed.

* * * * *